United States Patent [19]

Young

[11] Patent Number: 4,674,253

[45] Date of Patent: Jun. 23, 1987

[54] INSULATED CONSTRUCTION PANEL AND METHOD

[76] Inventor: Lewis C. P. Young, 803 N. 14th St., Noblesville, Ind. 46060

[21] Appl. No.: 822,470

[22] Filed: Jan. 27, 1986

[51] Int. Cl.[4] ..... E04B 2/56

[52] U.S. Cl. ..... 52/404; 52/236.9; 52/593; 52/809

[58] Field of Search ..... 52/236.9, 309.7, 309.13, 52/309.16, 404, 593, 236.7, 262, 266, 809, 825, 826, 238.1, 588, 595, 300

[56] References Cited

U.S. PATENT DOCUMENTS

| | | | |
|---|---|---|---|
| 2,159,300 | 5/1939 | Tashjian | 52/593 |
| 3,119,153 | 1/1964 | Martin | 52/262 |
| 3,305,986 | 2/1967 | Mathews | 52/593 |
| 3,992,829 | 11/1976 | Schellberg | 52/404 |
| 4,051,641 | 10/1977 | Elliot | 52/262 |
| 4,103,467 | 8/1978 | Lindal | 52/404 |
| 4,114,333 | 9/1978 | Jones | 52/593 |

*Primary Examiner*—J. Karl Bell

*Attorney, Agent, or Firm*—Woodard, Weikart, Emhardt & Naughton

[57] ABSTRACT

A construction panel which includes an interior stud frame having a bottom plate, a top plate, and one or more vertical studs extending between and connected with the bottom and top plates, an exterior stud frame having a bottom plate, a top plate, and one or more vertical studs extending between and connected with the bottom and top plates, an intermediate insulating board having an interior side defining grooves within which at least a part of the interior stud frame is received and an exterior side defining grooves within which at least a part of the exterior frame is received, the interior and exterior stud frames and insulating material being connected together and having first and second vertical ends defining either a flat surface, a groove portion or a tongue portion to facilitate interconnection of a plurality of such panels.

21 Claims, 15 Drawing Figures

INSULATED CONSTRUCTION PANEL AND METHOD

BACKGROUND OF THE INVENTION

1. Field of the Invention

The present invention relates to the field of construction materials, namely panels, and particularly to insulated construction panels and methods for construction using same. The invention relates especially to construction methods and materials for use in walls for buildings such as residential dwellings.

2. Description of the Prior Art

Various methods of wall construction have been known in the past. The construction techniques for residential dwellings represent one manner of approach to wall construction to which the present invention pertains. The typical method of framing a house is to construct the walls on site in considerable length, typically the full length of the given wall. This is in contrast to a modular construction such as the present invention provides in which a given wall is constructed by the assembly of several self-contained, pre-constructed wall units.

For the typical house, the wall is framed from a suitable lumber in a familiar manner with vertical studs connected at the top and bottom by horizontal plates of the same material. Insulation is typically provided by one of two means. First, insulation between the studs may be provided by roll insulation which is cut to length and placed between successive pairs of studs and attached thereto. Alternatively, insulation between the studs may be applied after the interior and exterior walls are erected by blowing insulation into the cavity formed by the walls and studs. A second type of insulation sometimes applied to these stud walls is represented by the board insulation secured to the outside of the framed wall. The outside finish wall is subsequently secured adjacent to and over this insulating board. In many instances the board insulation is secured to the framed wall before the wall is raised into position.

The use of reinforced insulating panels has been known for particular applications. One approach in this regard has been the use of large panels of insulating board, such as eight inch thick panels of a size approximating the wall such as eight feet high and several feet wide. It has been known to use this type of board insulation in the construction of basements by including a structural framing on one side only of the insulating material. The insulation in this instance is cut to provide recesses shaped to receive the framing boards. In this instance, there has not been provided any structural wood members on the outside of the panel.

One disadvantage of prior art methods for providing insulated wall constructions has been that there have been areas of the wall in which the insulating barrier is discontinuous. This arises, for example, at locations where structural members span the thickness of the wall, thus interrupting the interconnection of the insulating material at that location. In contrast, the present invention provides an insulating construction panel and method which provides a fully continuous network of the insulating material, resulting in a much more effective insulating barrier.

SUMMARY OF THE INVENTION

Briefly describing one aspect of the present invention there is provided a construction panel including an interior stud frame including a bottom plate, a top plate and at least one vertical stud extending therebetween and connected thereto, an exterior stud frame also including a bottom plate, a top plate and at least one vertcal stud extending therebetween and connected thereto, and an intermediate, rigid insulating panel having an interior side including recesses in which the interior stud frame is received and an exterior side including recesses in which the exterior stud frame is received, and also including exposed top and bottom end surfaces and two side surfaces facing outwardly of the panel and oriented for positioning against surfaces of an adjacent insulating construction panel. In another aspect of the present invention there is provided a method for construction of a wall which includes the provision of a plurality of such insulating construction panels, and the placement of such panels in an abutting relationship to position together the adjacent surfaces of the rigid insulating panel to provide a continuous insulation barrier extending throughout the area of the constructed wall.

It is an object of the present invention to provide a construction panel that is adapted for use in the construction of walls for houses, office buildings and other structures.

It is a further object of the present invention to provide a construction panel that has superior insulating properties and capabilities.

A further object of the present invention is to provide an insulating construction panel that may be readily fabricated, and which can be easily transported to the contruction site.

Another object of the present invention is to provide a construction panel that may be easily erected, and which is available as a modular arrangement that is easily assembled, and which can be tailored to a variety of wall shapes and configurations.

It is a further object of the present invention to provide a method for constructing a wall by the assembly of modular, prefabricated construction panels.

Further objects and advantages of the present invention will be apparent from the description of the preferred embodiment which follows.

DESCRIPTION OF THE PREFERRED EMBODIMENT

Figure 1:
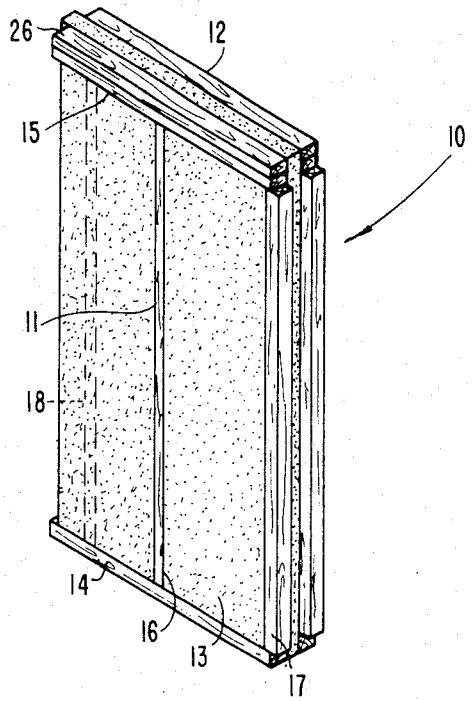
FIG. 1 is a perspective view of a construction panel of the present invention.

For the purposes of promoting an understanding of the principles of the invention, reference with now be made to the embodiment illustrated in the drawings and specific language will be used to describe the same . It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a construction panel which provides superior insulating properties for the wall constructed therewith, and which is prefabricated and readily assembled on site. The construction panels of the present invention may have a variety of shapes and configurations tailored to meet the particular construction requirements. The panels of the present invention may be used in conjunction with other types of wall construction materials and methods. As will be described, the construction panels are well suited, for example, for use in conjunction with basement panels of a type existing in the prior art. The present invention is directed to the provision of a construction panel which includes interior and exterior structural frames between which there is a rigid, insulating panel.

It will be appreciated that the particular materials selected, and the lengths, widths, etc. for these materials, may vary without departing from the present invention. Conventional sizing is preferred for a number of reasons, including the satisfaction of construction code requirements, the availability and lower cost of such materials, and the conformity to other construction materials and techniques. Similarly, the present invention preferably utilizes conventional types of construction materials, particularly as to the use of standard framing lumber of treated wood in constructing the interior and exterior structural frames. The insulating panel may be formed from a variety of known and readily available insulating boards having suitable rigidity and insulating properties. The insulating material desirably is one which is easily fashioned into the appropriate size and shape, and it is especially helpful to use a material that is easily cut to provide the recesses for receiving the interior and exterior structural frames. An example of a suitable insulating material and one which has been used in practice is an EPS (polystyrene) material.

Figure 3:
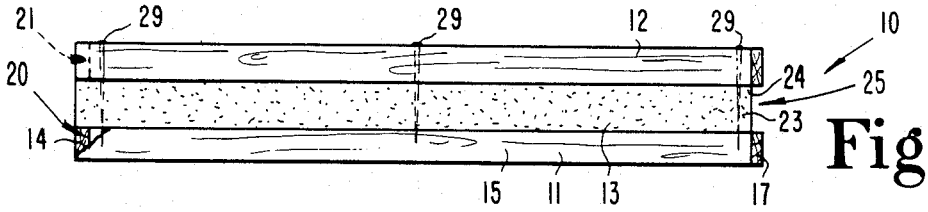
FIG. 3 is a top, plan view of the panel of FIG. 1.
Figure 2:
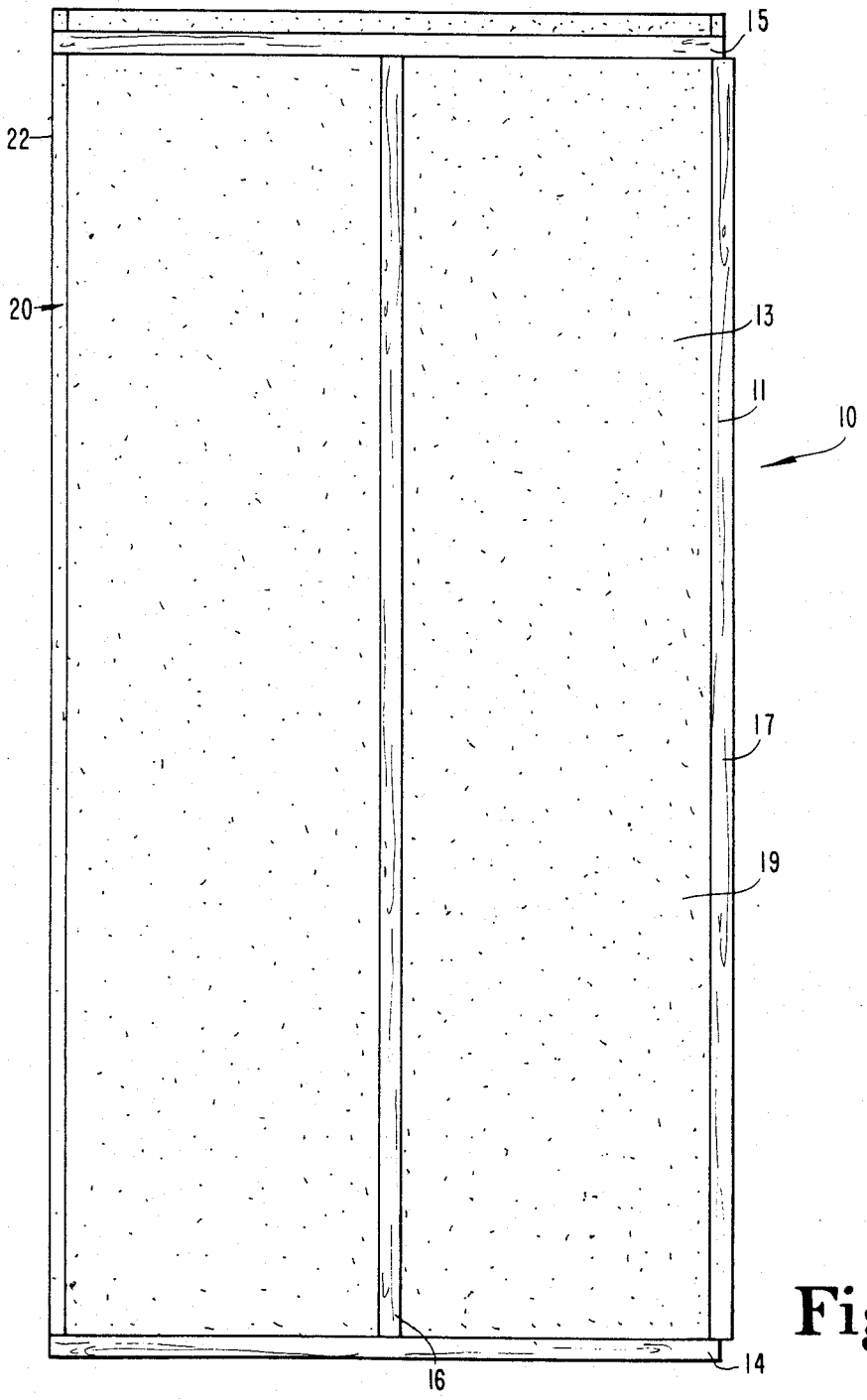
FIG. 2 is a front, elevational view of the panel of FIG. 1.

Referring in particular to FIGS. 1–3, there is shown a typical construction panel 10 in accordance with the present invention. Panel 10 includes an interior structural frame 11, and exterior structural frame 12, and an intermediate insulating material 13. As will be described hereafter, the standard panel 10 is constructed to provide a tongue and groove assembly with other associated panels. This enhances the insulating characteristics of the resulting wall and facilitates proper alignment of the successive wall panels. As a result, the configuration of the interior and exterior frames and the shape of the insulating material are selected to provide the tongue and groove assembly.

The interior frame 11 includes a bottom plate 14, a top plate 15, and at least one vertically extending stud 16. For the standard panel 10 there is also included a second vertical stud 17 along one edge. In an alternate panel construction, an additional stud 18, shown in dotted lines in FIG. 1, is included for attachment with an interior wall which would extend perpendicularly from panel 10 at that location. The exterior frame 12 is identical to and parallels that shown for the interior frame 10 in FIG. 3, and a description thereof is therefore not separately stated herein.

The intermediate insulating material 13 is a continuous board having particular shapes and recesses as will now be described. The board 13 is substantially rectangular, and typically may have a size of approximately eight feet high, four feet wide and eight inches thick. On the interior side 19 recesses are provided for receiving studs 16 and 17, bottom plate 14 and top plate 15. Moreover, the top of board 13 is recessed above the top plate 15 as well as to provide for the reception of a second top plate board as is described hereafter. The opposite, exterior side (not shown) of the board 13 has similar recesses for reception of the studs, bottom plate and top plate of the exterior frame 12. On the left side of FIGS. 2 and 3 it can be seen that the board has two vertical recesses 20 and 21, forming a tongue 22 extending outwardly along the vertical center of the board 13. This tongue protion 22 includes an end surface for abutting with a complementary surface of an adjacent construction panel to provide a continuous insulating barrier for the wall.

In the right side of FIGS. 2 and 3 it is apparent that the insulating board 13 also includes a central, outwardly extending portion 23 with vertical recesses defined along each side. The stud 17 and the corresponding stud for the exterior frame 12 are partially received within these vertical recesses. As a result, the end surface 24 is recessed inwardly of the studs such as 17, but less than the full thickness of the studs. This combination provides for insulating material to extend between the studs such as 17, but also provides a groove 25 for reception of the next adjacent wall panel.

In like manner, the top and bottom plates are positioned to permit a tongue and groove interconnection between adjacent wall panels 10. The bottom plate 14 extends to the left in FIG. 3 to the end surface of the tongue 22, and therefore extends beyond the recess 20 in the insulating material directly above the bottom plate. Similarly, the bottom plate extends to the right in FIG. 3 to the end surface 24 of the insulating board 13, and is thereby recessed inwardly from the outer edge of the stud 17 lying directly above the bottom plate. The bottom plate of the exterior frame and the top plates of both the interior and exterior frames are all configured in this same manner.

This construction results in an elongated "I" shaped projection on the left side of the panel in FIG. 3 consisting of the vertical tongue portion 22 of the insulating material and of the outwardly extending top and bottom plates. This also results in an elongated "I" shaped recess on the right side of the panel in FIG. 4 defined by the recessing of the insulating material and of the ends of the top and bottom plates relative the position of the vertical studs such as 17. It will therefore be appreciated that successive panels constructed as shown in FIGS. 1–3 could be readily assembled in end-to-end fashion with the tongue portions 22 being fit into the grooves 25 to provide a secure and well insulated wall.

In constructing a wall by assembly of panels such as 10, a second top plate is added. As previously indicated, the panel 10 is constructed to have the insulating material 13 extend upwardly from the top plates such as 15 a sufficient distance to accommodate a second plate being secured over the plate 15. Referring to FIG. 1, there is shown a second top plate 26 attached to top plate 15. The top surface of the second top plate 26 is flush with the top of the insulating board 13. The provision of this second top plate is based upon standard construction technique. The bottom plate 14 provides for securement of the wall to the underlying floor by nailing or otherwise attaching the bottom plate directly to the floor and underlying support structure. In order to provide a secure attachment of the wall panels along their top end, the top plates are provided, and a second top plate is used to interconnect adjacent panels. Thus, the second top plate extends not only along the panel shown, but also along adjacent panels and is secured to each for example by nailing. This continuous, second top plate thus provides a secure attachment of the successive panels.

As shown in FIG. 3, the interior and exterior frames are secured together through the insulating material 13. Connectors 29, such as long nails, extend from the exterior frame 12, through the intermediate insulating material, and into the interior frame 11. These connectors may extend through any or all of the vertical studs, bottom plates and top plates, and preferably are spaced throughout the frames to provide a secure and stable attachment of the unit.

Figure 4:
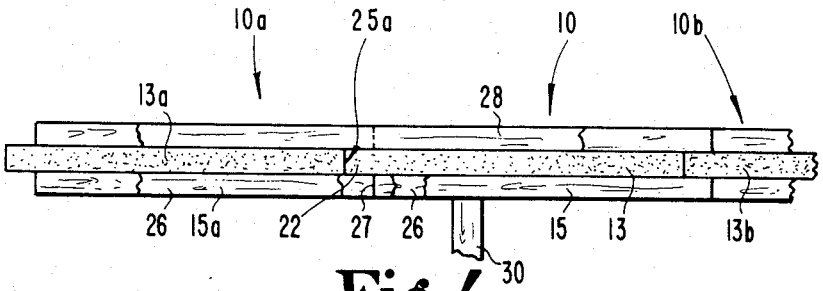
FIG. 4 is a top, plan view showing the interconnection of several of the panels of FIG. 1.

Referring to FIG. 4, there is shown an example of several panels 10, 10*a* and 10*b* being secured together in the manner described. For example, the tongue portion 22 of panel 10 is received within the groove portion 25*a* of the adjacent panel 10*a*. Due to the construction as previously described, this causes the top plates such as 15 to abut the next adjacent top plates such as 15*a* along line 27. Second top plates 26 and 28 extend over the underlying top plates such as 15, and particularly span the abutments such as 17 to provide a secure interconnection of the panels. An interior wall 30 extends perpendicularly from the panel 10 and is secured to an additional vertical stud as shown at 18 in FIG. 1. As can also be seen in FIG. 4, this manner of connection provides a continuous insulating barrier comprising the abutting insulating boards 13, 13*a* and 13*b*.

Given the basic design just described, it will be appreciated that a variety of modifications to the standard type panel 10 can be made. These variations in one sense can be made to the standard type panel, such as variations in the number and sizes of the construction members used to make up the interior and exterior frames. The insulating board could also be modified without altering the desired result of having a continuous insulating barrier in the constructed wall. For example, the insulating board could consist of more than one individual member interconnected in a fashion to result in a single, continuous panel. Another type of variation would be a modification of the design to provide for a different type of tongue and groove connection, or for a simple flat, abutting connection. Both of these modifications would fall within the scope of the present invention.

Figure 5:
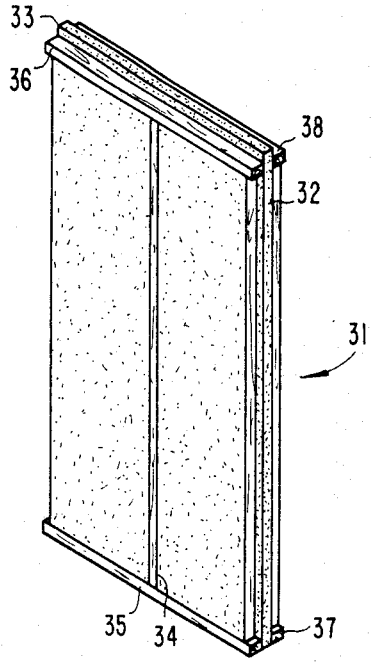
FIG. 5 is a perspective view of an alternate form of a construction panel according to the present invention.

Referring in particular to FIG. 5, there is shown one variation of the standard panel 10 useful in accordance with the present invention. In certain instances it may occur that a panel 31 have tongue portions 32 and 33 at both ends. The standard panel 10 is then modified to have the interior frame include only a single vertical stud 34 extending between bottom plate 35 and top plate 36. The exterior frame similarly includes a vertical stud (not shown) extending between bottom plate 37 and top plate 38.

In this embodiment, the panel 30 is essentially identical to the standard panel 10 except that the second pair of vertical studs extending along one edge of the panel is absent. The intermediate insulating board again includes central, vertical projections along each end and the top and bottom plates extend outwardly to be flush with the projections of the insulating material. The panel may be fit in tongue and groove fashion with adjacent panels in the manner described with respect to FIG. 4.

Figure 6:
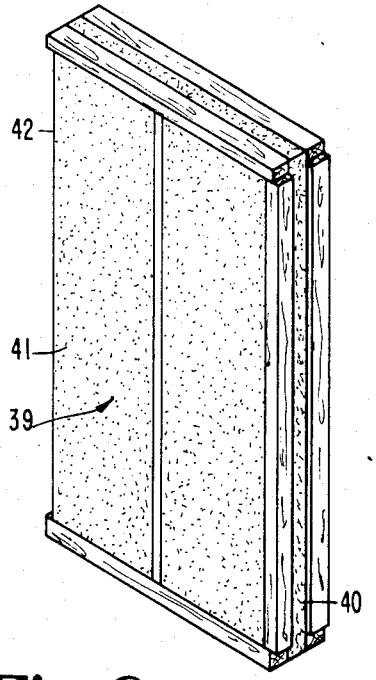
FIG. 6 is a perspective view of a second alternate form of a panel of the present invention.

A lead panel 39 is shown in FIG. 6. The lead panel 39 differs from the standard panel 10 in that the tongue portion is not present. One end of the panel defines a groove portion 40 in the manner of the groove portion 25 of panel 10. On the other end the insulating board 41 does not include the tongue portion or the associated vertical recesses on either side. Instead, the top and bottom plates on that side of the panel 39 extend out flush with the edge 42 of the insulating board 41 to provide a flat surface for the full extent of that edge of the panel.

Figure 7:
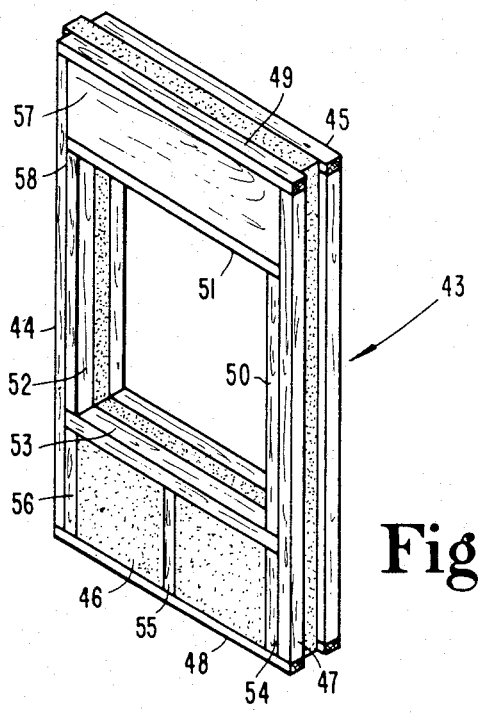
FIG. 7 is a perspective view of a window panel constructed in accordance with the present invention.

The present invention is also readily adaptable for use with window and door panels. In FIG. 7 there is shown a typical window panel 43 constructed in accordance with the present invention. The window panel 43 includes an interior frame 44 and an exterior frame 45 with the insulating material 46 extending therebetween. Once again the interior and exterior frames are identical, and description will therefore only be provided with respect to the interior frame 44 shown clearly in FIG. 7. The interior frame 44 includes a window enclosure defined by several frame components. The frame 44 includes the same basic components as the standard panel frame, including the vertical studs 47 extending between bottom plate 48 and top plate 49. In addition, there is included a window frame comprising members 50–53, lower stud supports 54–56, and a header 57. The insulating board 46 is recessed inwardly from the end studs such as 47 to form a groove portion, and extends outwardly of the end studs such as 58 to form the tongue portion. The bottom and top plates extend flush with the end surfaces of the insulating board, in the same manner as described with respect to the standard panel 10, to provide for a consistent configuration for fitting in a tongue and groove fashion with adjacent panels.

Figure 8:
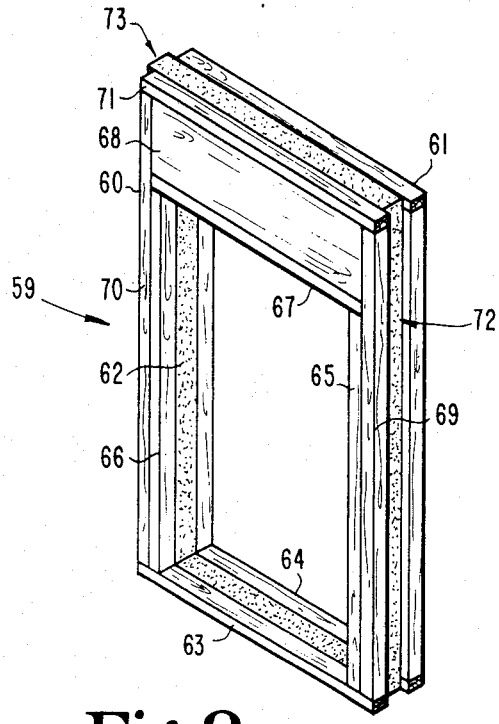
FIG. 8 is a perspective view of a door panel constructed in accordance with the present invention.

The typical door panel 59 shown in FIG. 8 is similar to the window panel of FIG. 7. As for previous panels, the door panel 59 includes interior and exterior frames, 60 and 61, respectively, and the insulating material 62 sandwiched therebetween. In conventional fashion, the bottom plates 63 and 64 extend across the bottom of the panel to provide stability for the unit, and are thereafter cut off flush with the interior of the frame members such as 65 and 66 to provide the door opening. The door opening is framed by the members 65 and 66 and also by member 67, and a header 68 is also included. The door panel also includes the end studs 69 and 70 and the top plate 71 in the same fashion as the window panel 43. Also in the same manner as the window panel, the insulating material, bottom plates and top plates are recessed inwardly of the end studs along one side to define a groove portion 72, and extend outwardly on the opposite side to define the tongue portion 73.

Referring to FIGS. 9–12 there are shown typical construction panels built in accordance with the present invention, and differing from the standard panel 10, window panel 43 and door panel 59 in the following manner. The earlier described panels are configured for use in applications in which a second floor is not going to be erected over them. The panels of FIGS. 9–12 are modified for use as structural support walls over which a second wall will be constructed. Each of these panels is substantially identical with the earlier described, non-support panel, and therefore only the differences will be described.

Figure 9:
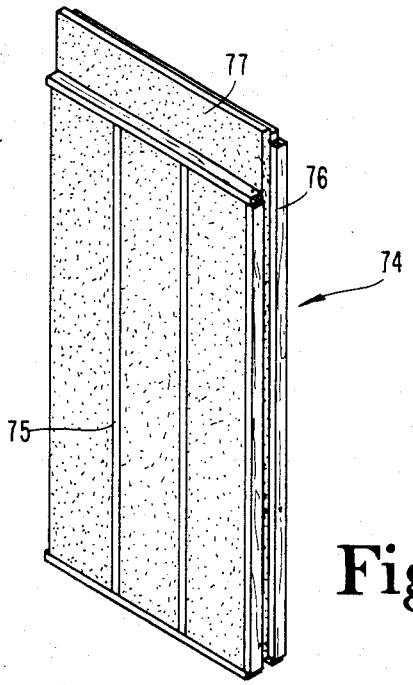
FIG. 9 is a perspective view of a structural support panel in accordance with the present invention.
Figure 10:
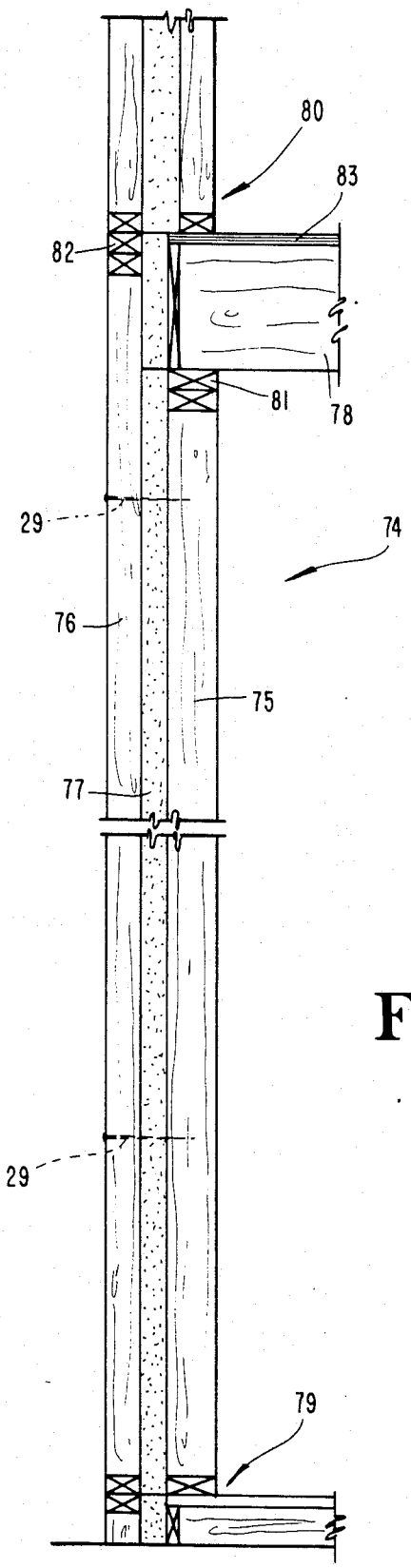
FIG. 10 is a side view, partially in section, showing the use of the structural support panel of FIG. 9 in a building, and particularly showing its interconnection with surrounding building components.

Wall panel 74 in FIGS. 9 and 10 differs from standard panel 10 of FIG. 1 primarily in the vertical extent of the interior frame 75. The exterior frame 76 and insulating board 77 are essentially identical to that described with respect to panel 10. However, one other difference is that the use of the panel for structural support will typically require the vertical studs to placed more closely together. In accordance with usual practice and many building codes, the standard panel 10 of FIG. 1 preferably has the vertical studs located at distances of two feet on center. The same overall sized panel 74 of FIG. 9 includes an additional vertical stud, and the studs are spaced at distances of sixteen inches on center.

In FIG. 10 there is shown a side view of a structural support panel 74 as it would appear in typical construction. It can be noted that FIG. 10 is representative of the side appearance of the other panels described herein, with the previous exception already noted that the use for support purposes dictates the lower interior frame for supporting the floor joists 78. Again the connectors 29 are shown as attaching the interior and exterior frames, and sandwiching the insulating material therebetween.

As shown in FIG. 10, the panel 74 is mounted onto a subsisting structure which preferably includes the same central insulating barrier. This underlying support, shown generally at 79, may for example be a lower wall formed of the identical construction panels. FIG. 10 therefore represents the manner in which the construction panels of the present invention may be used to form a continuous insulating barrier which extends not only between wall panels on a single floor, but between panels that may be below, as at 79, or above, as at 80. It will also be observed from FIG. 10 that another difference which preferably is employed for a structural support panel 74 is that the interior frame 75 be constructed of greater width, to provide more strength to the unit. Note that the thickness of the insulating material, and therefore of the wall, does not vary, but rather the interior frame is simply thicker and is recessed more deeply into the insulating material. By way of example, the interior frame of the supporting panel 74 may be made using two by four members, whereas the exterior frame of the same panel 74 and both the interior and exterior frames of the non-supporting panel shown partially at the top of FIG. 10 may be made using two by three members.

As shown in FIG. 10, the panel 74 includes an interior frame 75 sized to receive a second top plate 81 upon which rests the floor joists 78 for the next floor above. The exterior frame 76 is dimensioned also to receive a second top plate 82. The result is that the top of the second top plate 82, the insulating material 77 and the floor 83 resting on the joists 78 form a single surface for reception of a panel thereon.

Figure 11:
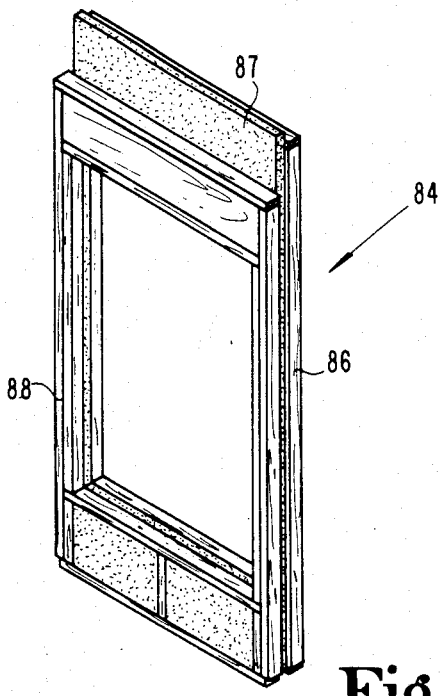
FIG. 11 is a perspective view of a structural support window panel of the present invention.
Figure 12:
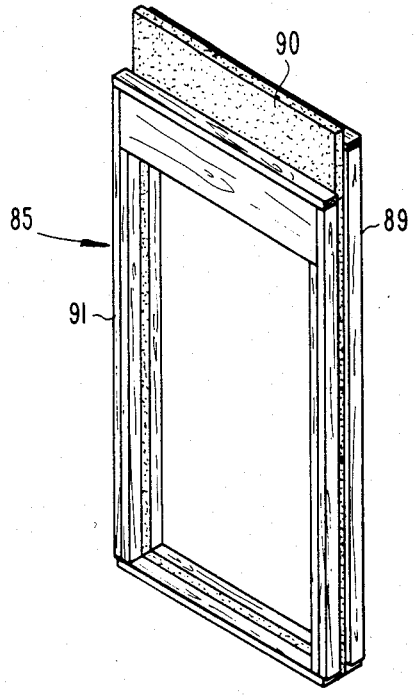
FIG. 12 is a perspective view of a structural support door panel of the present invention.

The window panel 84 and door panel 85 are identical in all respects with the previously described window panel 43 and door panel 59, except with comparable changes as described with respect to the wall panel 74. In each instance, the tongue and groove provisions are made as for the earlier versions. The window panel 84 is shown in FIG. 11 and includes an exterior frame 86, insulating material 87, and the reduced size interior frame 88. The door panel 85 is shown in FIG. 12 and includes an exterior frame 89, insulating material 90, and the reduced size interior frame 91.

Figure 13:
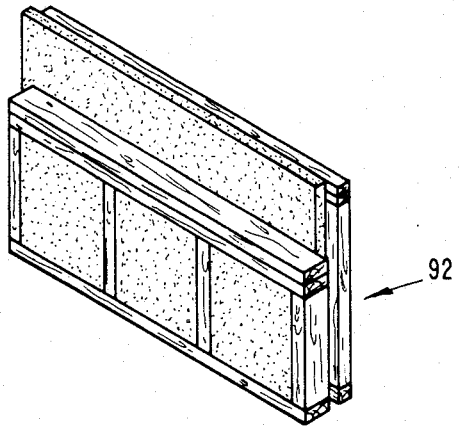
FIG. 13 is a perspective view of a crawl space panel constructed in accordance with the present invention.

Another example of a variation of the standard panel of the present invention is shown in the FIG. 13. The construction panel 92 is for use in forming the wall surrounding a crawl space. This crawl space panel 92 is essentially identical with the support panel 74 except that the height of the component is generally shorter, and is variable to match the desired height for the crawl space. Also, the nature of use for the panel 92 makes it preferable to construct the frames from treated lumber.

Figure 14:
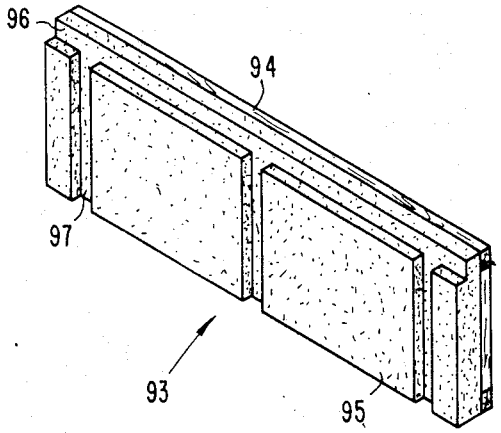
FIG. 14 is a perspective view of a slab panel useful with the present invention.
Figure 15:
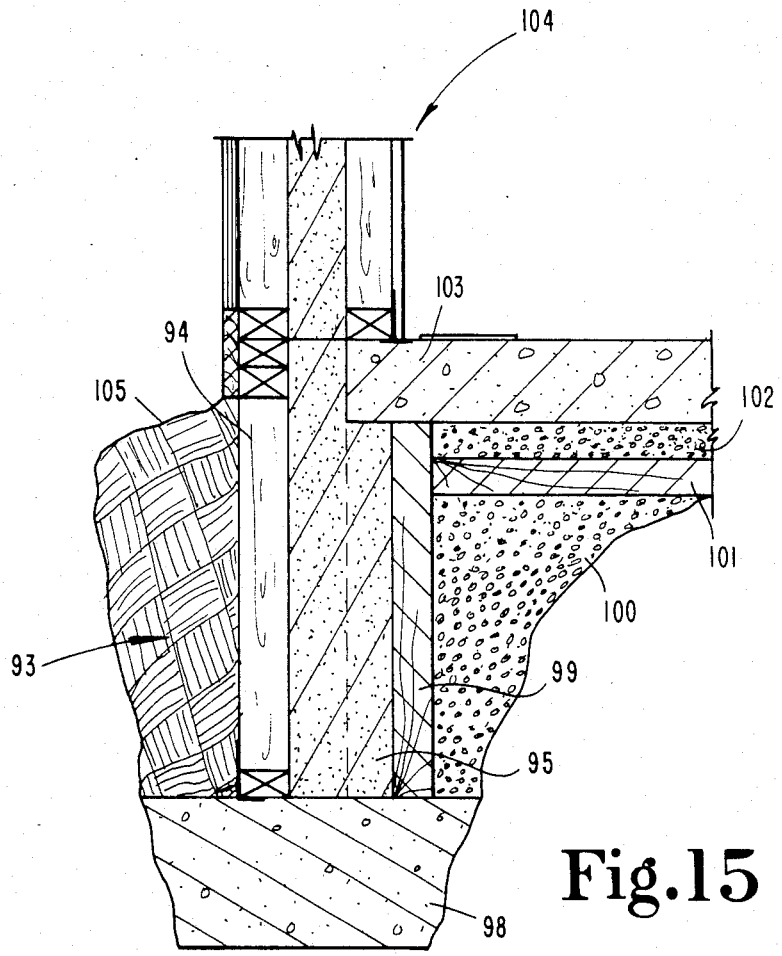
FIG. 15 is a side view, partially in section, showing the use of the slab panel of FIG. 14 and its interconnection with surrounding building components including the construction panels of the present invention.

In FIGS. 14–15 there is shown a different type of panel, one which does not include an interior frame, for use in forming a wall surrounding a concrete slab floor. This slab panel 93 includes an exterior frame 94 preferably formed from treated wood. The frame 94 is secured to the rigid insulating material 95 again by reception within appropriately configured grooves in the insulating material. The insulating material 95 also includes a horizontal recess 96 and vertical recesses 97 for reception of concrete as is now described.

As shown in FIG. 15, in a typical installation the slab panel 93 is secured atop a footing 98 by conventional means. An insulating board 99 is secured to the interior surface of the slab panel, thereby closing the recesses 96 and defining therewith a series of vertical holes exposed at the top and closed at the bottom by the footing 98. The excavation is filled with pea gravel 100, a second insulating board 101 placed on the pea gravel, and additional gravel 102 added thereover. Concrete 103 is then poured into the site and allowed to flow down into the holes defined by the slab panel 93 and board 99. The concrete also forms the slab floor which is leveled with the top of the slab panel. This construction provides a secure and well insulated slab floor, and also provides a base wall unit upon which wall panels, such as 104, may be erected. This construction is particularly desirable in also providing for the continuous insulating barrier between the above panels, such as 104, and the panels such as 93 which extend down below the surface 105 of the ground.

The present invention has been described in its preferred embodiment, and encompasses a variety of panel constructions. Particular configurations and dimensions are not critical to the invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A construction panel which comprises:

an interior stud frame including a bottom plate, a top plate, and at least one vertical stud extending between and connecting with the bottom and top plates;

an exterior stud frame including a bottom plate, a top plate, and at least one vertical stud extending between and connecting with the bottom and top plates;

an intermediate, rigid insulating material, said insulating material including an interior side and an exterior side, the interior side defining recesses in which the at least one vertical stud of said interior stud frame is at least partially received, the exterior side defining recesses in which the at least one vertical stud of said exterior stud frame is at least partially received; and, attachment means for attaching said interior frame through said insulating material to said exterior frame.

2. The construction panel of claim 1 in which said interior and exterior stud frames and said insulating material have one vertical end defining a groove portion and an opposite vertical end defining a tongue portion.

3. The construction panel of claim 1 and which is rectangular.

4. The construction panel of claim 3 in which said interior and exterior stud frames and said insulating material have one vertical end defining a groove portion and an opposite vertical end defining a tongue portion.

5. The construction panel of claim 1 in which said insulating material extends upwardly above the top plates of said interior and exterior stud frames.

6. The construction panel of claim 5 in which said interior and exterior stud frames and said insulating material have one vertical end defining a groove portion and an opposite vertical end defining a tongue portion.

7. The construction panel of claim 1 in which each of said interior and exterior stud frames includes at least two vertical studs extending between and connecting with the respective top and bottom plates, the interior side defining recesses in which the at least two vertical studs of said interior stud frame are at least partially received, the exterior side defining recesses in which the at least two vertical studs of said exterior stud frame are at least partially received.

8. The construction panel of claim 1 in which said interior and exterior stud frames and said insulating material have one vertical end defining a tongue portion and an opposite vertical end defining a second tongue portion.

9. The construction panel of claim 1 in which said interior and exterior stud frames and said insulating material have one vertical end defining a flat surface and an opposite vertical end defining a groove portion.

10. The construction panel of claim 1 and which further defines a window opening.

11. The construction panel of claim 1 and which further defines a door opening.

12. The construction panel of claim 1 in which said interior frame extends upwardly less than said exterior frame.

13. The construction panel of claim 12 in which said interior frame extends upwardly less than said exterior frame by a predetermined distance approximately equal to the height of a floor joist.

14. The construction panel of claim 12 and which further defines a window opening.

15. The construction panel of claim 12 and which further defines a door opening.

16. The construction panel of claim 1 in which said insulating material is planar and defines interior and exterior planar surfaces, said insulating material being rectangular in configuration and having vertical edges and horizontal edges;

the interior surface of said insulating material defining a vertically extending recess spaced inwardly of the vertical edges and within which the at least one vertical stud of said interior stud frame is at least partially received, whereby the at least one vertical stud of said interior frame extends at least partially into said insulating material beyond the planar surface, the exterior surface of said insulating material defining a vertically extending recess spaced inwardly of the vertical edges and within which the at least one vertical stud of said exterior stud frame is at least partially received, whereby the at least one vertical stud of said exterior frame extends at least partially into said insulating material beyond the planar surface.

17. The construction panel of claim 16 in which each of said interior and exterior stud frames are planar;

the at least one vertical stud of each of said interior and exterior stud frames having an interior surface for facing said insulating material and an exterior surface for facing outwardly from said insulating material;

the interior side of said insulating material defining a recess within which the at least one vertical stud of said interior stud frame is fully received to have the exterior surface of the at least one vertical stud being co-plannar with the interior surface of said insulating material;

the exterior side of said insulating material defining a recess within which the at least one vertical stud of said exterior stud frame is fully received to have the exterior surface of the at least one vertical stud being co-planar with the exterior surface of said insulating material.

18. A construction wall which comprises:

a first construction panel having a first interior stud frame including a bottom plate, a top plate, and at least one vertical stud extending between and connecting with the bottom and top plates, a first exterior stud frame including a bottom plate, a top plate, and at least one vertical stud extending between and connecting with the bottom and top plates, a first intermediate, rigid insulating material, said insulating material including an interior side and an exterior side, the interior side defining recesses in which the at least one vertical stud of said first interior stud frame is at least partially received, the exterior side defining recesses in which the at least one vertical stud of said first exterior stud frame is at least partially received, and first attachment means for attaching said first interior frame through said first insulating material to said first exterior frame;

a second construction panel having a second interior stud frame including a bottom plate, a top plate, and at least one vertical stud extending between and connecting with the bottom and top plates, a second exterior stud frame including a bottom plate, a top plate, and at least one vertical stud extending between and connecting with the bottom and top plates, a second intermediate, rigid insulating material, said insulating material including an interior side and an exterior side, the interior side defining recesses in which the at least one vertical stud of said second interior stud frame is at least partially received, the exterior side defining recesses in which the at least one vertical stud of said second exterior stud frame is at least partially received, and second attachment means for attaching said second interior frame through said second insulating material to said second exterior frame;

the first interior and exterior stud frames and the first insulating material of said first construction panel having one vertical end defining a groove portion, the second interior and exterior stud frames and the second insulating material of said second construction panel having one vertical end defining a tongue portion, the tongue portion of said second construction panel being received within the groove portion of said first construction panel with the first insulating material abutting the second insulating material; and, connecting means for connecting said first construction panel with said second construction panel.

19. The construction wall of claim 18 and which further includes at least one second top plate extending over and connecting with a top plate of said first construction panel and a top plate of said second construction panel.

20. The construction wall of claim 19 and in which the insulating material of each of said first and second construction panels extends upwardly above at least one of the top plates of each of said construction panels, the second top plate extending over and connecting with the at least one top plate of each of said first and second construction panels, the insulating material extending at least as high as the second top plate.

21. The construction wall of claim 20 in which the insulating material of said first construction panel extends upwardly above the top plates of both the interior and exterior stud frames of said first construction panel, the insulating material of said second construction panel extending upwardly above the top plates of both the interior and exterior stud frames of said second construction panel, said construction wall further including two second top plates, one of the second top plates extending over and being connected to the top plates of the interior stud frames of said first and second construction panels, the other of the second top plates extending over and being connected to the top plates of the exterior stud frames of said first and second construction panels, the insulating material of each of said first and second construction panels extending at least as high as the second top plates.

* * * * *